US011028557B2

(12) United States Patent
Mahrenholz et al.

(10) Patent No.: US 11,028,557 B2
(45) Date of Patent: Jun. 8, 2021

(54) ATTACHMENT GRADE CONTROL FOR WORK VEHICLE

(71) Applicant: DEERE & COMPANY, Moline, IL (US)

(72) Inventors: John Mahrenholz, Dubuque, IA (US); Brett Graham, Dubuque, IA (US); Alex Vandegrift, Dubuque, IA (US); Nicholas Rokusek, Dubuque, IA (US); Christopher Meyer, Dubuque, IA (US); Walter Henson, II, Dubuque, IA (US); Lance R. Sherlock, Asbury, IA (US)

(73) Assignee: DEERE & COMPANY, Moline, IL (US)

( * ) Notice: Subject to any disclaimer, the term of this patent is extended or adjusted under 35 U.S.C. 154(b) by 125 days.

(21) Appl. No.: 16/213,806

(22) Filed: Dec. 7, 2018

(65) Prior Publication Data

US 2020/0181878 A1 Jun. 11, 2020

(51) Int. Cl.

| | |
|---|---|
| ***E02F 9/20*** | (2006.01) |
| ***E02F 3/815*** | (2006.01) |
| ***E02F 3/84*** | (2006.01) |
| ***E02F 9/22*** | (2006.01) |
| *E02F 3/96* | (2006.01) |

(52) U.S. Cl.

CPC ..... *E02F 9/2004* (2013.01); *E02F 3/815* (2013.01); *E02F 3/844* (2013.01); *E02F 9/2235* (2013.01); *E02F 3/961* (2013.01); *E02F 9/2271* (2013.01)

(58) Field of Classification Search

CPC ..... E02F 9/2004; E02F 3/815; E02F 9/2235; E02F 3/844; E02F 9/2271; E02F 3/961; E02F 3/28; E02F 3/76; E02F 3/36; E02F 3/80; E02F 3/42; E02F 3/43; E02F 3/841; E02F 3/96; E02F 9/2012

See application file for complete search history.

(56) References Cited

U.S. PATENT DOCUMENTS

| | | | |
|---|---|---|---|
| 5,169,277 | A | 12/1992 | Orser et al. |
| 6,542,789 | B2 | 4/2003 | Ufheil |
| 7,036,248 | B2 | 5/2006 | Meyeres et al. |
| 7,099,722 | B2 | 8/2006 | Casey |
| 8,118,111 | B2 | 2/2012 | Armas |

(Continued)

FOREIGN PATENT DOCUMENTS

| | | | |
|---|---|---|---|
| CA | 2885399 | A1 | 9/2016 |
| DE | 102005019820 | A1 | 1/2006 |

(Continued)

OTHER PUBLICATIONS

German Search Report issued in counterpart application No. 102019219159.2 dated Sep. 8, 2020 (10 pages).

*Primary Examiner* — Brian P Sweeney

(57) ABSTRACT

A work vehicle comprising a work vehicle control comprising a standard configuration and an updated configuration. A controller is configured to receive a geospatial positioning signal, a boom position signal, an attachment position signal, and an operator input. The controller is configured to reference a memory device and change the work vehicle control between the standard configuration and the updated configuration. The controller is configured to control an elevation of the attachment according to a grade command.

9 Claims, 14 Drawing Sheets

(56) References Cited

U.S. PATENT DOCUMENTS

| | | | | |
|---|---|---|---|---|
| 10,011,976 | B1 | 7/2018 | Forcash et al. | |
| 10,533,300 | B1 | 1/2020 | Armas | |
| 2009/0118844 | A1 | 5/2009 | Schmuck et al. | |
| 2012/0158209 | A1* | 6/2012 | Doy | B60T 8/172 701/1 |
| 2012/0165962 | A1* | 6/2012 | Faivre | G05B 19/106 700/19 |
| 2013/0274925 | A1 | 10/2013 | Oates, Jr. et al. | |
| 2016/0032564 | A1 | 2/2016 | Pinther, II et al. | |
| 2016/0273196 | A1 | 9/2016 | Funk et al. | |
| 2017/0107700 | A1 | 4/2017 | Faivre et al. | |
| 2017/0145655 | A1 | 5/2017 | Mason | |
| 2017/0300040 | A1 | 10/2017 | Butler | |
| 2018/0058030 | A1 | 3/2018 | Shimomura et al. | |
| 2018/0179735 | A1 | 6/2018 | Newlin et al. | |
| 2018/0245306 | A1 | 8/2018 | Lewis | |
| 2019/0226176 | A1* | 7/2019 | Smith | E02F 3/845 |

FOREIGN PATENT DOCUMENTS

| | | | |
|---|---|---|---|
| EP | 2725149 | A1 | 4/2014 |
| FR | 2591631 | A1 | 6/1987 |
| WO | WO2013148148 | A1 | 10/2013 |

* cited by examiner

ATTACHMENT GRADE CONTROL FOR WORK VEHICLE

FIELD OF THE DISCLOSURE

The present disclosure generally relates to work vehicles, such as skid steers, compact track loaders, and other agricultural and construction loaders, and more particularly to a grade control for an attachment of a work vehicle.

BACKGROUND OF THE DISCLOSURE

In order to control grade for a variety of attachments, manual operator controls are commonly used.

SUMMARY OF THE DISCLOSURE

In one embodiment, a work vehicle is disclosed. The work vehicle comprises a frame. At least one ground engaging device is coupled to the frame and configured to support the frame above a surface. A positioning receiver is coupled to the frame and configured to receive a geospatial positioning signal. A boom assembly is coupled to the frame. At least one boom cylinder is coupled to the frame and the boom assembly and configured to move the boom assembly. A boom position sensor is coupled to at least one of the frame, the boom assembly, and the boom cylinder and configured to transmit a boom position signal indicative of a position of the boom assembly. An attachment coupler is coupled to a distal portion of the boom assembly. At least one tilt cylinder is coupled to the boom assembly and the attachment coupler and configured to move the attachment coupler. An attachment position sensor is coupled to at least one of the boom assembly, the attachment coupler, and the tilt cylinder and configured to transmit an attachment position signal indicative of a position of the attachment coupler. An attachment is coupled to the attachment coupler. An identification device is coupled to the attachment and configured to transmit an attachment identification signal after an activation event. A display is communicatively coupled to the identification device and configured to display the attachment identification signal. The display comprises an operator input device configured to receive an operator input indicative of an attachment confirmation and a grade command. The work vehicle further comprises a work vehicle control comprising a standard configuration and an updated configuration. A controller is configured to receive the geospatial positioning signal, the boom position signal, the attachment position signal, and the operator input. The controller is configured to reference a memory device and change the work vehicle control between the standard configuration and the updated configuration. The controller is configured to control an elevation of the attachment according to the grade command.

In another embodiment, a work vehicle is disclosed. The work vehicle comprises a frame. At least one ground engaging device is coupled to the frame and configured to support the frame above a surface. A positioning receiver is coupled to the frame and configured to receive a geospatial positioning signal. A boom assembly is coupled to the frame. At least one boom cylinder is coupled to the frame and the boom assembly and configured to move the boom assembly. A boom position sensor is coupled to at least one of the frame, the boom assembly, and the boom cylinder and configured to transmit a boom position signal indicative of a position of the boom assembly. An attachment coupler is coupled to a distal portion of the boom assembly. At least one tilt cylinder is coupled to the boom assembly and the attachment coupler and configured to move the attachment coupler. An attachment position sensor is coupled to at least one of the boom assembly, the attachment coupler, and the tilt cylinder and configured to transmit an attachment position signal indicative of a position of the attachment coupler. An attachment is coupled to the attachment coupler. At least one of an IMU and a slope sensor is coupled to the attachment and configured to transmit a slope signal indicative of a slope of the attachment relative to the frame. The controller is configured to control the elevation and a slope of the attachment according to the grade command. An identification device is coupled to the attachment and configured to transmit an attachment identification signal after an activation event. A display is communicatively coupled to the identification device and configured to display the attachment identification signal. The display comprises an operator input device configured to receive an operator input indicative of an attachment confirmation and a grade command. The work vehicle further comprises a work vehicle control comprising a standard configuration and an updated configuration. A controller is configured to receive the geospatial positioning signal, the boom position signal, the attachment position signal, the slope signal, the attachment identification signal, and the operator input. The controller is configured to change the work vehicle control between the standard configuration and the updated configuration. The controller is configured to control an elevation and a slope of the attachment according to the grade command.

In yet another embodiment, a work vehicle is disclosed. The work vehicle comprises a frame. At least one ground engaging device is coupled to the frame and configured to support the frame above a surface. A positioning receiver is coupled to the frame and configured to receive a geospatial positioning signal. A boom assembly is coupled to the frame. At least one boom cylinder is coupled to the frame and the boom assembly and configured to move the boom assembly. A boom position sensor is coupled to at least one of the frame, the boom assembly, and the boom cylinder and configured to transmit a boom position signal indicative of a position of the boom assembly. An attachment coupler is coupled to a distal portion of the boom assembly. At least one tilt cylinder is coupled to the boom assembly and the attachment coupler and configured to move the attachment coupler. An attachment position sensor is coupled to at least one of the boom assembly, the attachment coupler, and the tilt cylinder and configured to transmit an attachment position signal indicative of a position of the attachment coupler. A dozer blade is coupled to the attachment coupler. At least one of an IMU and a slope sensor is coupled to the dozer blade and configured to transmit a slope signal indicative of a slope of the dozer blade relative to the frame. The controller is configured to control the elevation and a slope of the dozer blade according to the grade command. An identification device is coupled to the dozer blade and configured to transmit an attachment identification signal after an activation event. A boom lock is coupled to at least one of the frame and the boom assembly. The boom lock is configured to move from an unlocked position where the boom assembly is moveable to a locked position where the boom assembly is locked to the frame in a lowered position when the attachment identification signal indicates the dozer blade. A display is communicatively coupled to the identification device and configured to display the attachment identification signal. The display comprises an operator input device configured to receive an operator input indicative of an attachment confirmation and a grade command.

The work vehicle further comprises a work vehicle control comprising a standard configuration and an updated configuration. A controller is configured to receive the geospatial positioning signal, the boom position signal, the attachment position signal, the slope signal, the attachment identification signal, and the operator input. The controller is configured to change the work vehicle control between the standard configuration and the updated configuration. The controller is configured to control an elevation and a slope of the dozer blade according to the grade command.

Other features and aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

As used herein, unless otherwise limited or modified, lists with elements that are separated by conjunctive terms (e.g., "and") and that are also preceded by the phrase "at least one of" or "one or more of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

DETAILED DESCRIPTION

Figure 1:
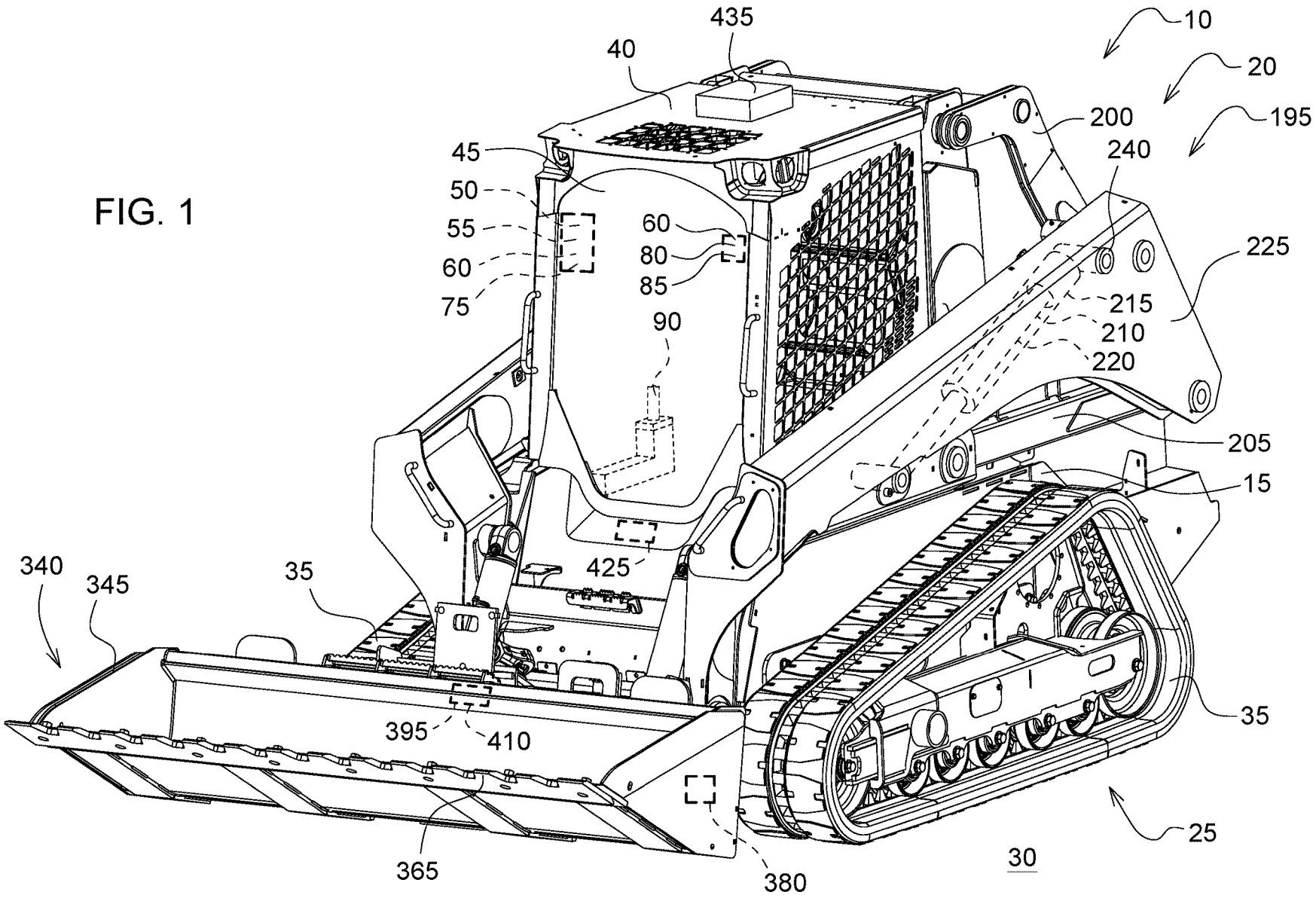
FIG. 1 is a perspective view of a work vehicle with a boom lock.

FIG. 1 illustrates a work vehicle 10 having a frame 15. The work vehicle 10 is illustrated as a compact track loader 20. Other types of work vehicles 10 are contemplated by this disclosure including skid steers and other types of agricultural, construction, or forestry loaders, for example. At least one ground engaging device 25 is coupled to the frame 15 and configured to support the frame 15 above a surface 30 and to move the work vehicle 10 along the surface 30. The illustrated ground engaging device 25 is a pair of tracks 35. Alternatively, the ground engaging device 25 may be wheels (not shown).

Figure 8:
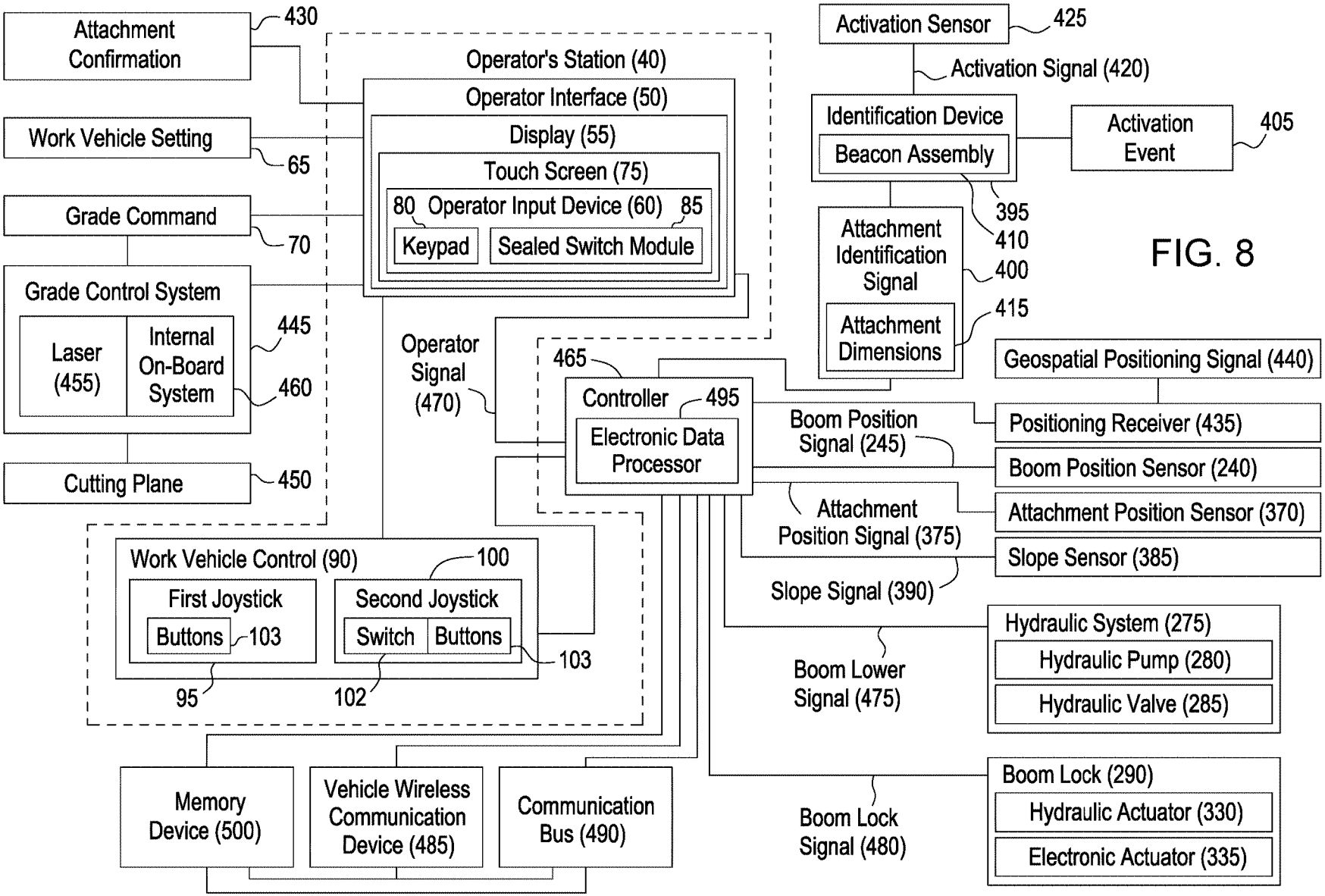
FIG. 8 is a schematic of the work vehicle with the boom lock.

An operator's station 40 having a door 45 is coupled to the frame 15. An operator interface 50 may be positioned in the operator's station 40 or remote from the work vehicle 10. The operator interface 50 may be a display 55 that may comprise an operator input device 60 configured to set or change a work vehicle setting or parameter 65 (FIG. 8) such as a grade command 70 (FIG. 8). For example, the display 55 may be a touch screen 75. The operator input device 60 may be separate from the display 55. For example, the operator input device 60 may be a keypad 80 or a sealed switch module ("SSM") 85.

Figure 2A:
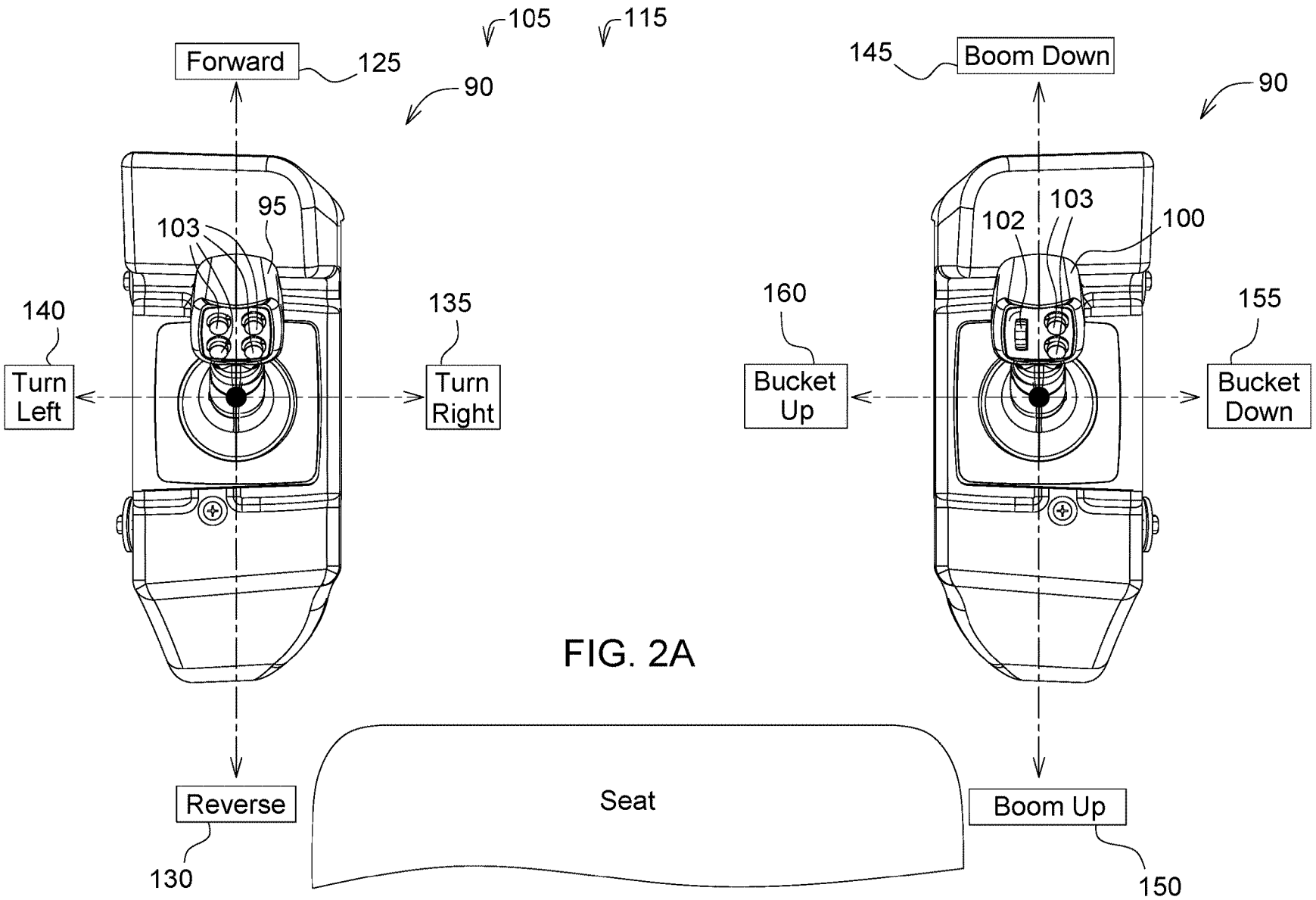
FIG. 2A is a schematic of a work vehicle control of the work vehicle of FIG. 1 in a standard configuration.
Figure 2B:
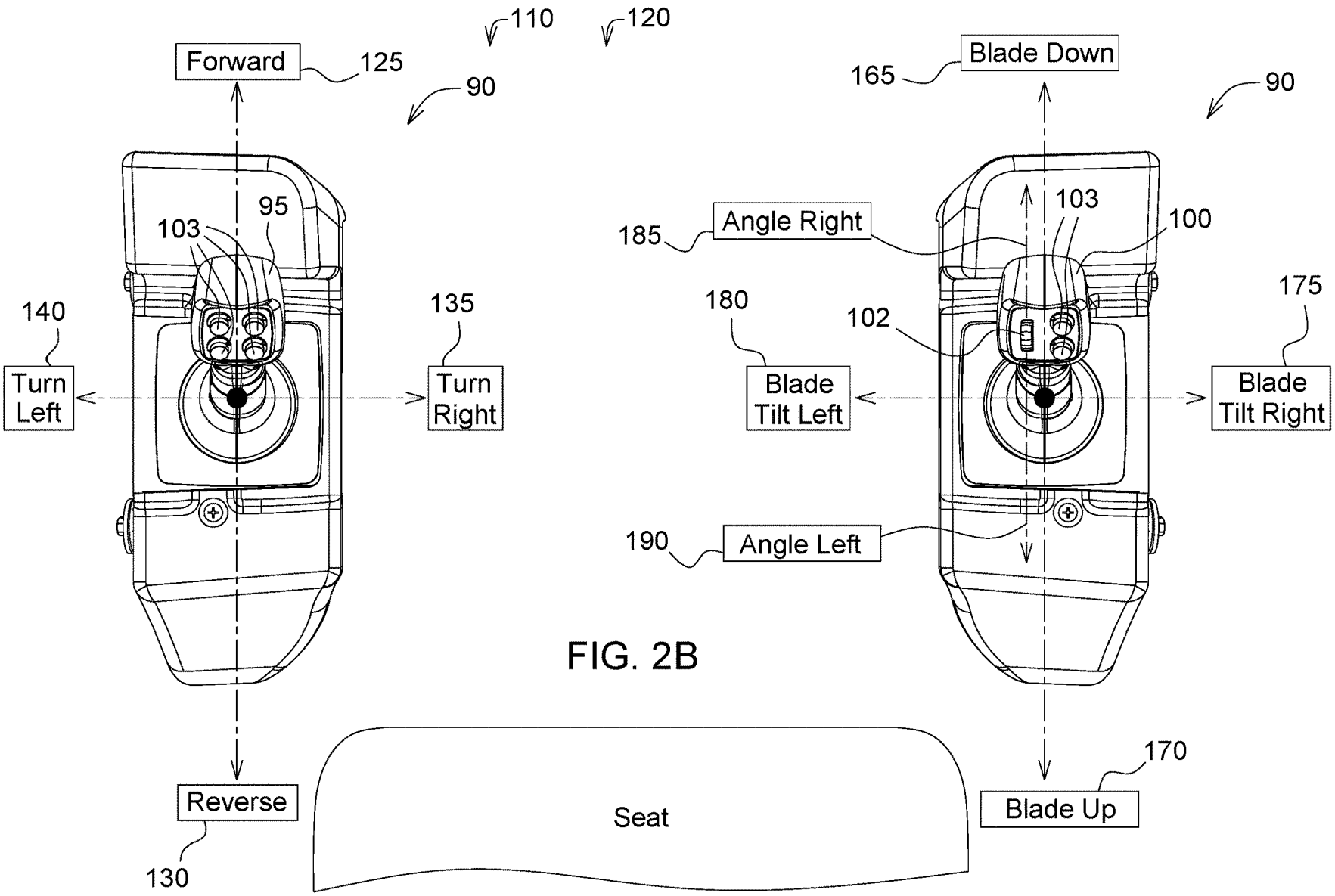
FIG. 2B is a schematic of a work vehicle control of the work vehicle of FIG. 1 in an updated configuration.

A work vehicle control 90 may also be positioned in the operator's station 40 or remote from the work vehicle 10. With reference to FIGS. 2A and 2B, the work vehicle control 90 may include a first joystick 95, a second joystick 100, and any combination of a plurality of switches 102 (e.g., rotary wheel) and a plurality of buttons 103 (e.g., pushbutton) or other control devices (e.g., dials, knobs). For example, the first joystick 95 may have the plurality of buttons 103 and the second joystick 100 having a switch 102 and the plurality of buttons 103. Other switch 102 and button 103 configurations are contemplated by this disclosure. The functions of the work vehicle control 90 may be re-assignable from a standard configuration 105 to an updated configuration 110. For example, from a standard configuration 105 like a compact track loader mode 115 to an updated configuration 110 like a dozer mode 120 or other mode (e.g., fork mode, trencher mode).

In the standard configuration 105, the updated configuration 110, the compact track loader mode 115, and the dozer mode 120, the first joystick 95 may have the same operation and functions: push the first joystick 95 forward for forward 125 movement of the work vehicle 10, push the first joystick 95 rearward for reverse 130 movement of the work vehicle 10, push the first joystick 95 right to turn right 135, and push the first joystick 95 left to turn left 140.

In the standard configuration 105 and the compact track loader mode 115, the second joystick 100 may have the same operation and functions: push the second joystick 100 forward for boom down 145, push the second joystick 100 rearward for boom up 150, push the second joystick 100 right for bucket down 155, and push the second joystick 100 left for bucket up 160.

In the updated configuration 110 and the dozer mode 120, the second joystick 100 may have the same operation and functions: push the second joystick 100 forward for blade down 165, push the second joystick 100 rearward for blade up 170, push the second joystick 100 right for blade tilt right 175, push the second joystick 100 left for blade tilt left 180, push the switch 102 forward for blade angle right 185, and push the switch 102 rearward for blade angle left 190.

Figure 3:
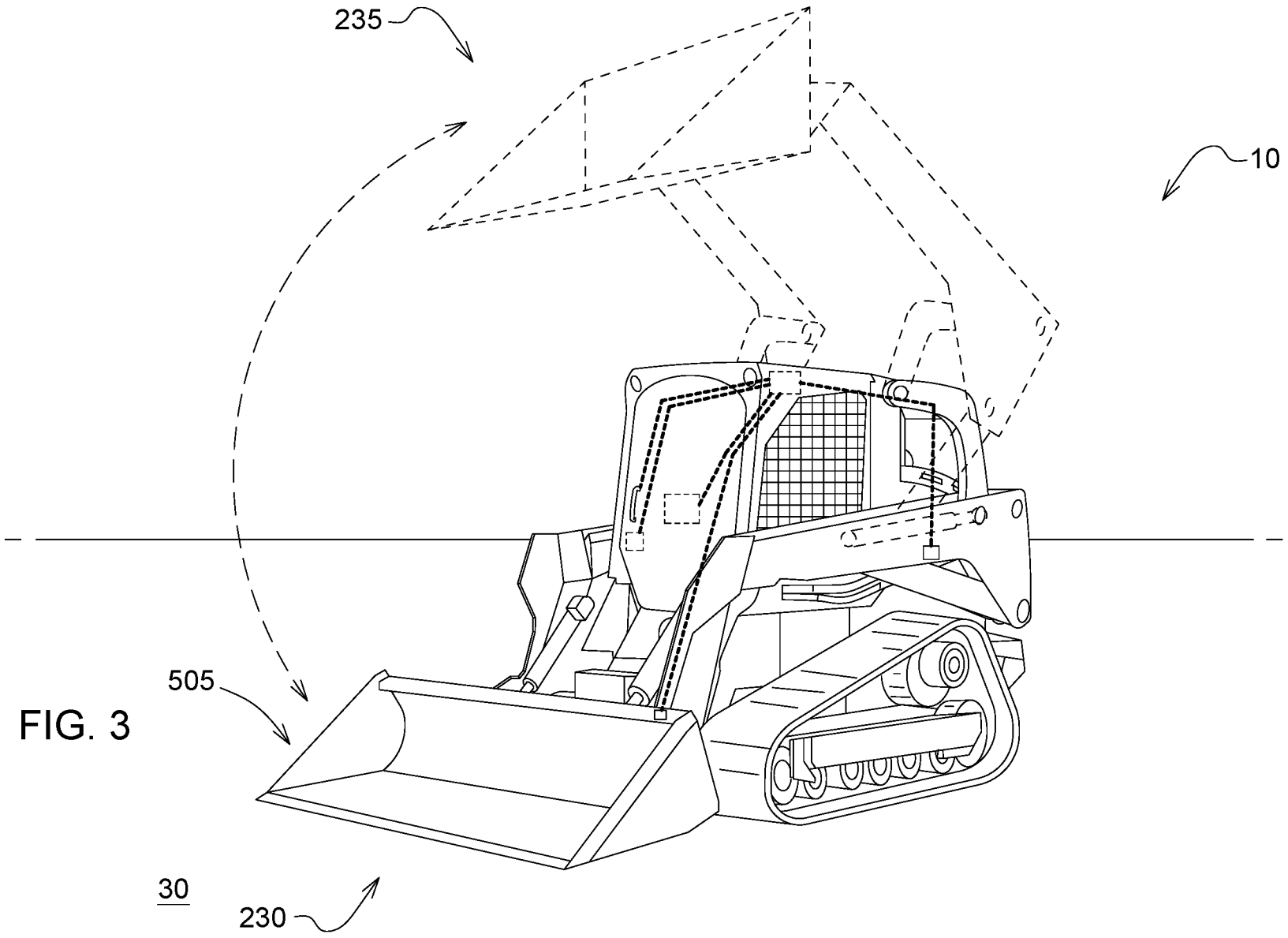
FIG. 3 is a perspective view of the work vehicle of FIG. 1 with a boom assembly in a lowered position and a raised position.

Referring to FIG. 1, a boom assembly 195 is coupled to the frame 15. The boom assembly 195 comprises a pair of upper links 200 pivotally coupled to the frame 15. A pair of lower links 205 are pivotally coupled to the frame 15. A pair of boom cylinders 210 are pivotally coupled to the frame 15 with one per side of the work vehicle 10. The boom cylinders 210 may be hydraulic actuators 215 or electronic actuators 220. A pair of boom arms 225 are pivotally coupled to the upper links 200 and the lower links 205 and positioned one per side of the work vehicle 10. The pair of boom arms 225 are pivotally coupled to the boom cylinders 210. With reference to FIGS. 1 and 3, the boom cylinders 210 are configured to move the boom assembly 195 from a lowered position 230 to a raised position 235. Other boom assembly 195 configurations are contemplated by this disclosure.

Referring to FIG. 1, a boom position sensor 240 is coupled to at least one of the frame 15, the boom assembly 195, and the boom cylinder 210. The boom position sensor 240 is configured to transmit a boom position signal 245 (FIG. 8) indicative of a position of the boom assembly 195. The boom position sensor 240 may be a rotary sensor, cylinder position sensor, or other type of sensor.

Figure 4:
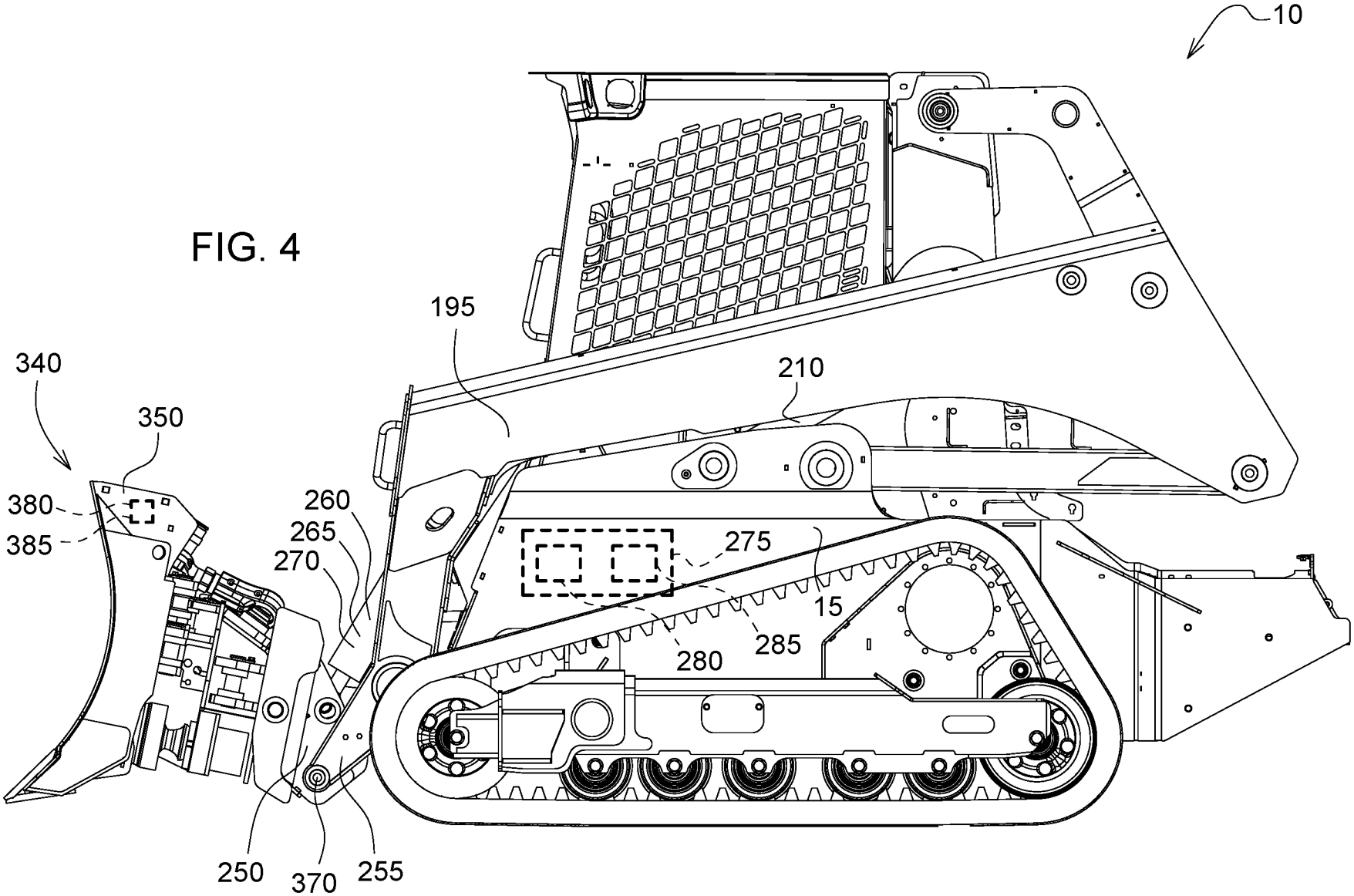
FIG. 4 is a side view of a work vehicle with a dozer blade.

With reference to FIG. 4, an attachment coupler 250 is coupled to a distal portion 255 of the boom assembly 195. A pair of tilt cylinders 260 are coupled to the boom assembly 195 and the attachment coupler 250 with one per side of the work vehicle 10. The tilt cylinders 260 may be hydraulic actuators 265 or electronic actuators 270. The tilt cylinders 260 are configured to move or tilt the attachment coupler 250.

Referring to FIGS. 1 and 4, a hydraulic system 275 is fluidly coupled to the boom cylinders 210 and the tilt cylinders 260. The hydraulic system 275 comprises a hydraulic pump 280 and a hydraulic valve 285 (e.g., electrohydraulic valve) to control hydraulic fluid flow to the boom cylinders 210 and tilt cylinders 260 after receiving input from at least one of the operator interface 50 and the work vehicle control 90. With reference to FIGS. 2A, 2B, and 4, in the updated configuration 110 the functions of the first joystick 95, the second joystick 100, the switches 102, and the buttons 103 may be changed to control different aspects of the hydraulic system 275. For example, the second joystick 100 that controlled the boom cylinders 210 in the forward boom down 145 and reverse boom up 150 directions in the compact track loader mode 115 may now be changed to control the tilt cylinders 260 in the forward blade down 165 and reverse blade up 170 directions in the dozer mode 120. This disclosure contemplates other aspects of the hydraulic system 275 may be controlled by other changes to the first joystick 95, the second joystick 100, switches 102, and buttons 103.

Figure 5A:
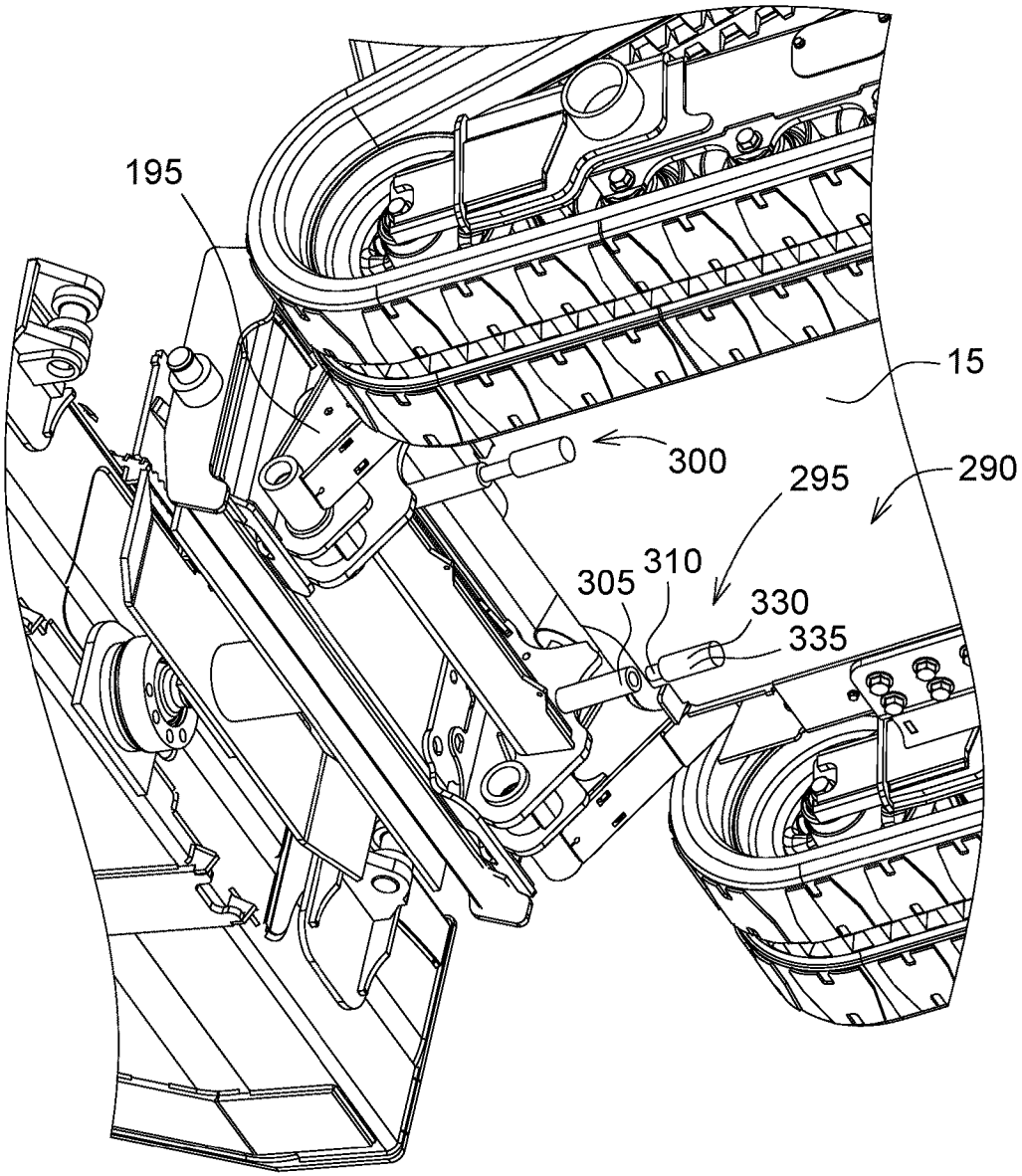
FIG. 5A is a bottom view of the work vehicle of FIG. 1, showing the boom lock according to one embodiment.
Figure 5B:
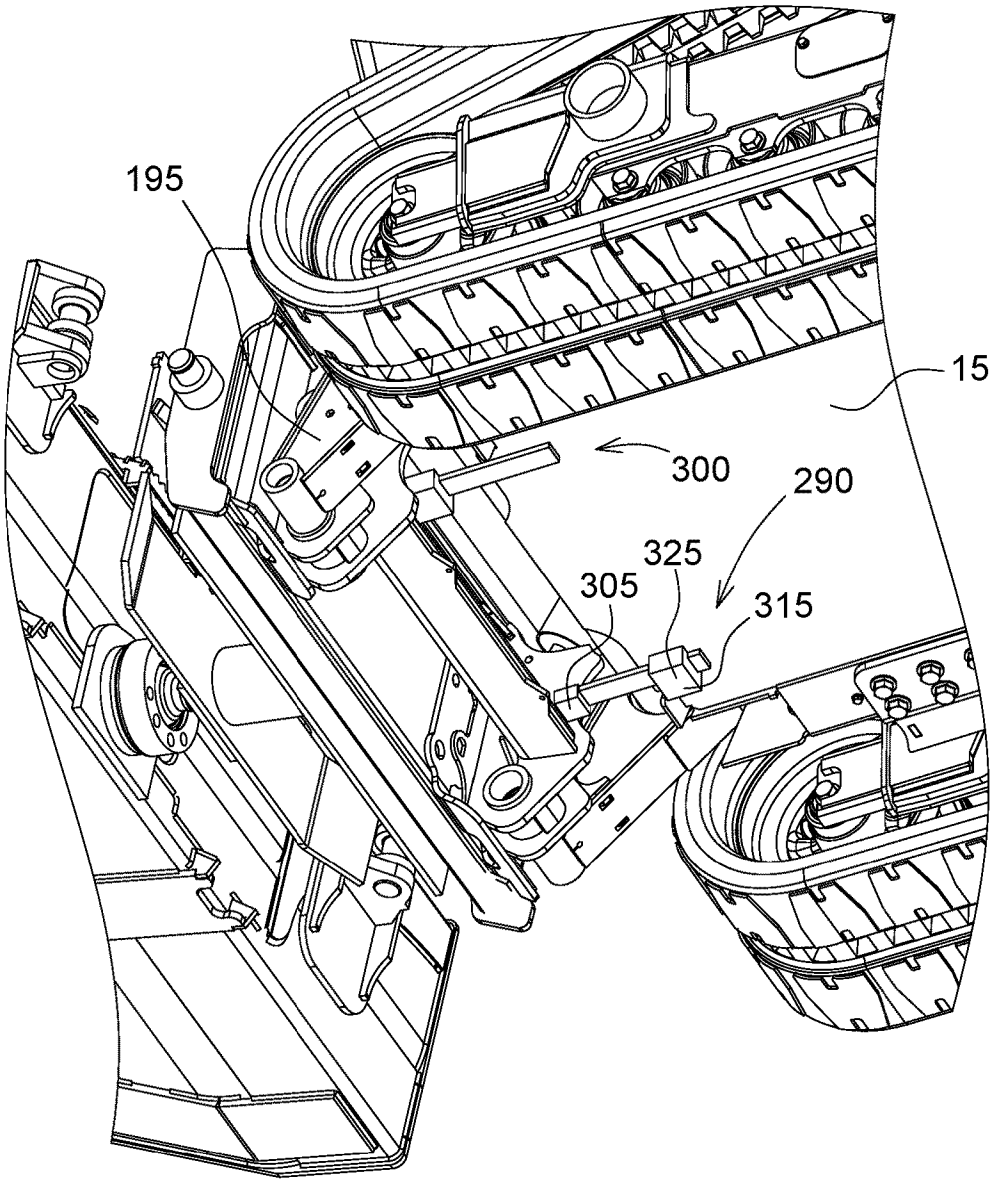
FIG. 5B is a bottom view of the work vehicle of FIG. 1, showing the boom lock according to another embodiment.
Figure 5C:
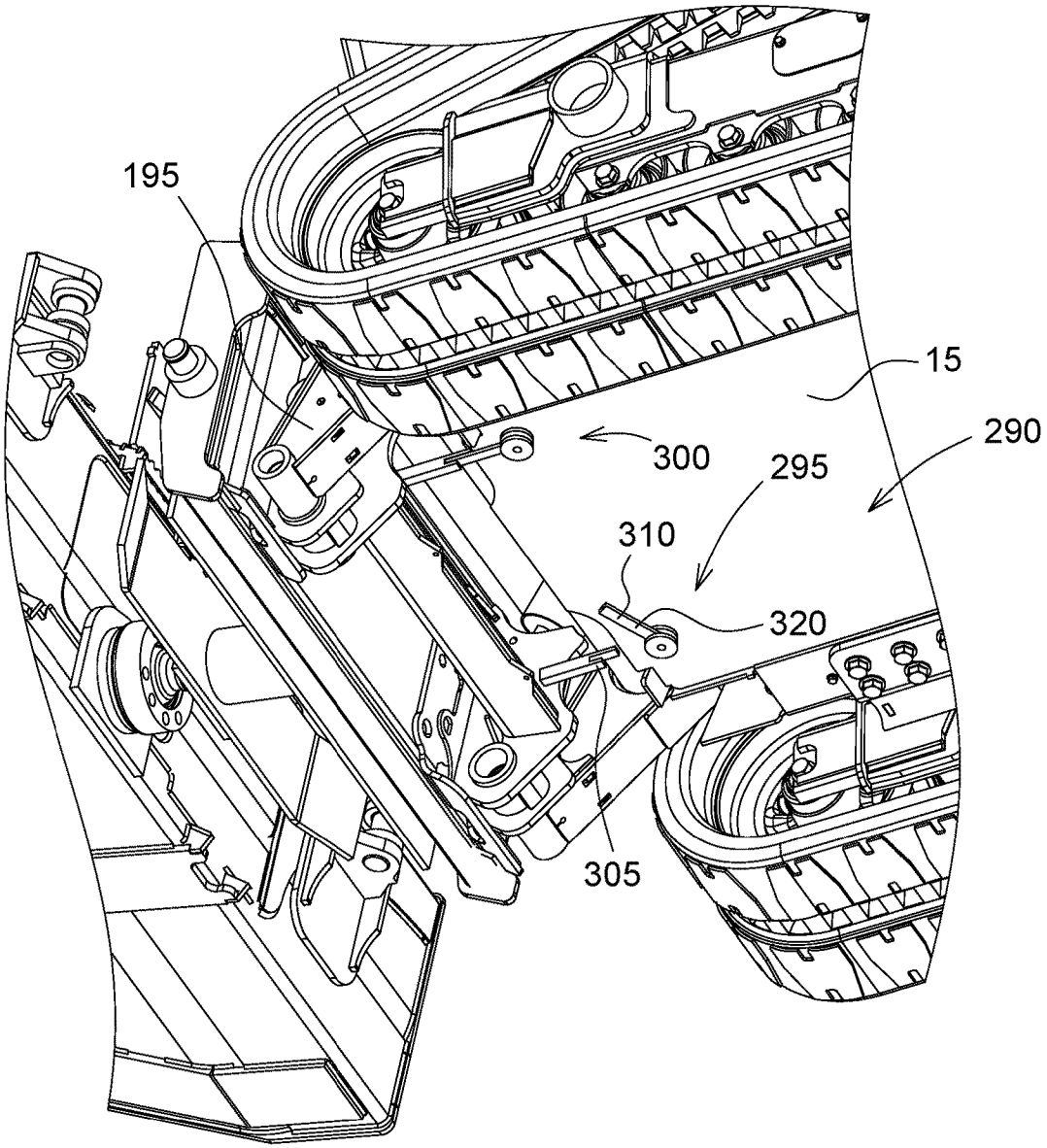
FIG. 5C is a bottom view of the work vehicle of FIG. 1, showing the boom lock according to yet another embodiment.
Figure 6A:
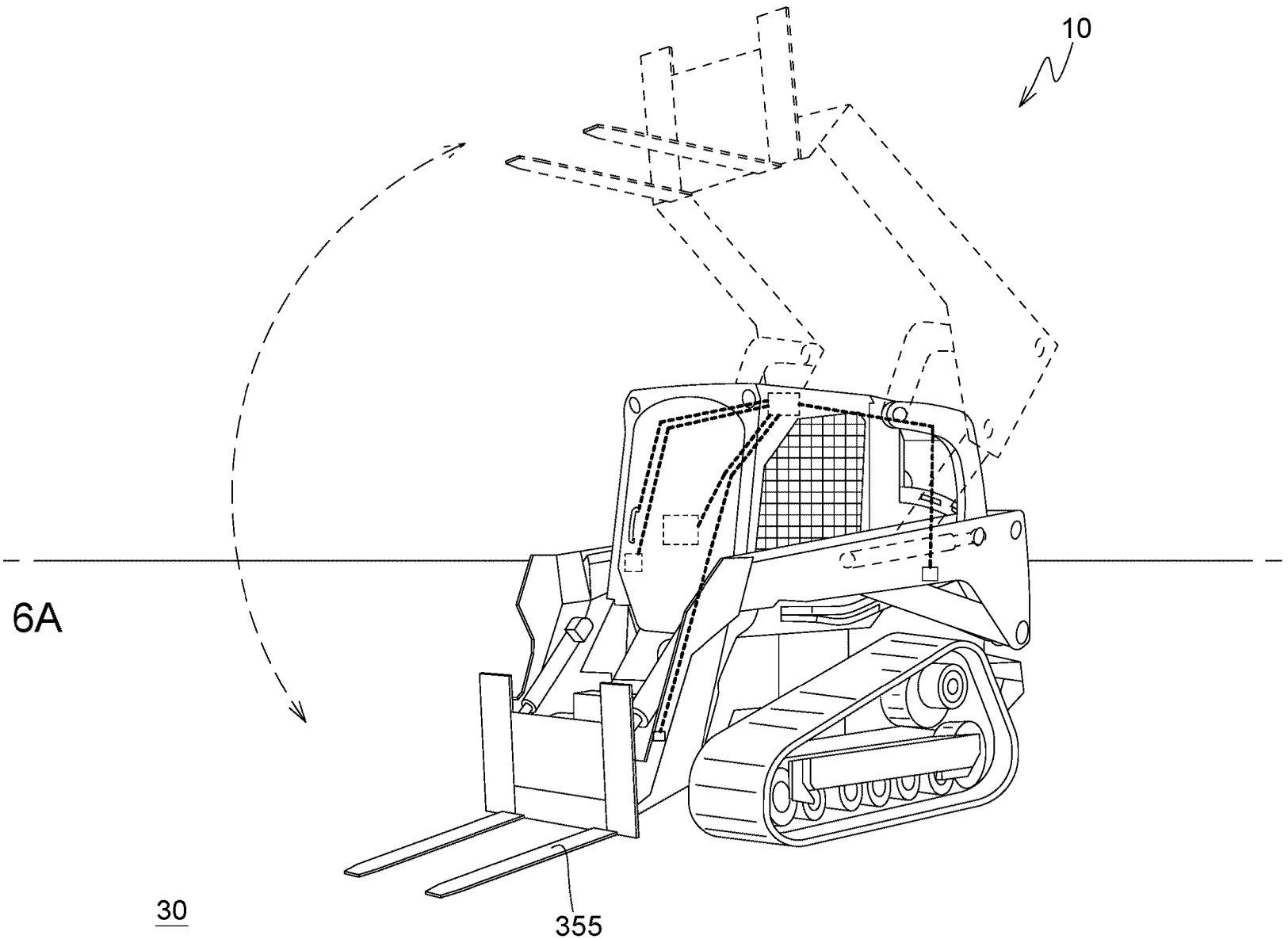
FIG. 6A is a perspective view of a work vehicle with forks.
Figure 6B:
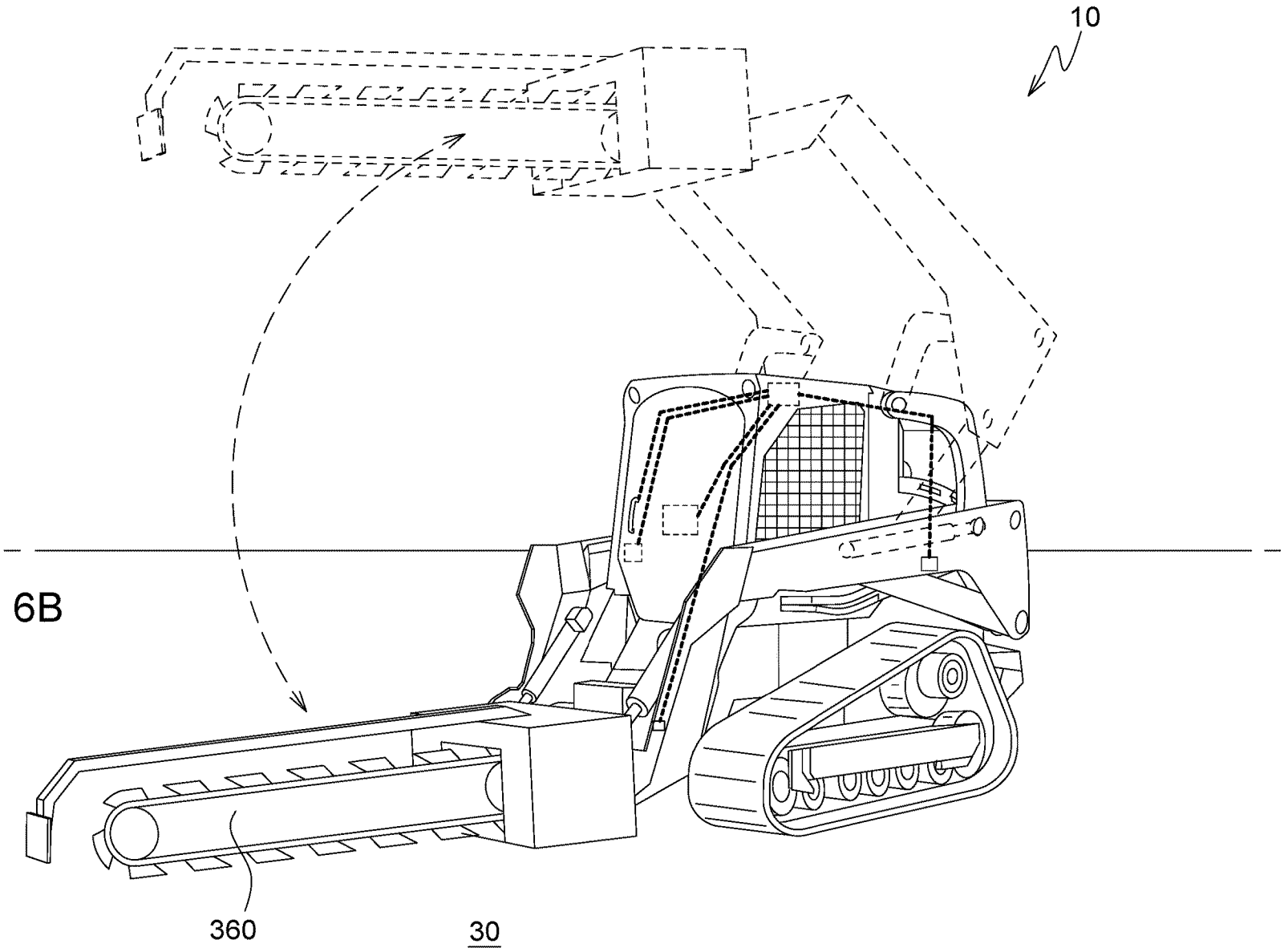
FIG. 6B is a perspective view of a work vehicle with a trencher.

With reference to FIGS. 5A, 5B, and 5C, a boom lock 290 may be coupled to at least one of the frame 15 and the boom assembly 195. The boom lock 290 is configured to move from an unlocked position 295 where the boom assembly 195 is moveable to a locked position 300 where the boom assembly 195 is locked to the frame 15 in the lowered position 230 (FIG. 3). The boom lock 290 may comprise a receiving device 305 coupled to at least one of the boom assembly 195 and the frame 15. The receiving device 305 is configured to receive a movable shaft 310 (e.g., sliding shaft, rotating shaft) coupled to at least one of the other of the boom assembly 195 and the frame 15. In some embodiments, the receiving device 305 may be configured to receive a sliding block 315 or a rotating latch 320 or wedge 325. The movable shaft 310 may be a hydraulic actuator 330 or an electronic actuator 335.

Referring to FIGS. 1, 4, 5A, 5B, 5C, 6A and 6B, an attachment 340 may be coupled to the attachment coupler 250. The attachment 340 may be a bucket 345, a dozer blade 350, forks 355, trencher 360, or other attachment 340 (e.g., grapple, auger). The attachment 340 may comprise a cutting edge 365 (FIG. 1).

With reference to FIG. 4, an attachment position sensor 370 may be coupled to at least one of the boom assembly 195, the attachment coupler 250, and the tilt cylinder 260 and configured to transmit an attachment position signal 375 (FIG. 8) indicative of a position of the attachment coupler 250. The attachment position sensor 370 may be a rotary sensor, cylinder position sensor, or other type of sensor.

An inertial measurement unit ("IMU") 380 or a slope sensor 385 may be coupled to the attachment 340 and configured to transmit a slope signal 390 (FIG. 8) indicative of a slope of the attachment 340 relative to the frame 15 or the surface 30. Slope corresponds with the blade tilt right 175 and blade tilt left 180 in the updated configuration 110 (FIG. 2B) and dozer mode 120 (FIG. 2B).

With reference to FIGS. 1 and 8, an identification device 395 may be coupled to the attachment 340 and configured to transmit an attachment identification signal 400 after an activation event 405. The identification device 395 may be a beacon assembly 410. The attachment identification signal 400 may comprise attachment dimensions 415. The activation event 405 may comprise the work vehicle 10 contacting the attachment 340 with a minimum force where the attachment 340 remains stationary. Alternatively, the activation event 405 may comprise the identification device 395 receiving an activation signal 420 from an activation sensor 425 coupled to the work vehicle 10. The operator interface 50 or display 55 may be communicatively coupled to the identification device 395 and configured to display the attachment identification signal 400. The operator interface 50, display 55, or the operator input device 60 may be configured to receive an operator input indicative of an attachment confirmation 430 and the grade command 70. The operator interface 50 or display 55 may show the attachment identification signals 400 of the attachments 340 in order of the strength of the attachment identification signals 400 starting with the strongest signal of the various signals coming from a variety of attachments 340. The operator interface 50 or display 55 may also show the attachment identification signals 400 of the attachments 340 starting with the most recently used or previously used attachments 340. Other attachment identification signal 400 display orders are contemplated by this disclosure.

A positioning receiver 435 may be coupled to the frame 15 or operator's station 40 and configured to receive a geospatial positioning signal 440 ("GPS") (e.g., GNSS, GLONASS) to locate a position of the work vehicle 10.

A grade control system 445 may be communicatively coupled to the operator input device 60 and configured to receive the grade command 70 and define a cutting plane 450. The grade control system 445 may be a laser 455 coupled to the frame 15 and configured to receive the grade command 70 and project the cutting plane 450 on the surface 30. Alternatively, the grade control system 445 may be an internal on-board system 460 that does not project the cutting plane 450 but is communicatively coupled to the operator input device 60 and configured to receive the grade command 70.

A controller 465 may be coupled to the work vehicle 10. In dozer mode 120 (FIG. 2B), the controller 465 may be configured to receive an operator signal 470 from the operator interface 50, transmit a boom lower signal 475 to the hydraulic system 275 to lower the boom assembly 195 to the frame 15, and transmit a boom lock signal 480 to a hydraulic actuator 330 or an electronic actuator 335 of the boom lock 290 to move the boom lock 290 to the locked position 300 (FIGS. 5A, 5B, 5C) after the boom assembly 195 is lowered to the frame 15. The controller 465 may receive and send signals wirelessly (e.g., Bluetooth) via a work vehicle wireless communication device 485 or by way of a communication bus 490. The controller 465 may comprise an electronic data processor 495.

The electronic data processor 495 may be arranged locally as a part of the work vehicle 10 or remotely away from the work vehicle 10. In various embodiments, the electronic data processor 495 may comprise a microprocessor, a microcontroller, a central processing unit, a programmable logic array, a programmable logic controller, an application specific integrated circuit, a logic circuit, an arithmetic logic unit, or other suitable programmable circuitry that is adapted to perform data processing and/or system control operations. In other embodiments, the electronic data processor 495 can manage the transfer of data to and from a remote processing system via a network and wireless infrastructure. For example, the electronic data processor can collect and process signal data from the communication bus 490 for transmission either in a forward or rearward direction (i.e., to or from the remote processing system).

A memory device 500 stores information and data for access by the electronic data processor 495, the communication bus 490, or the vehicle wireless communication device 485. The memory device 500 may comprise electronic memory, nonvolatile random-access memory, an optical storage device, a magnetic storage device, or another device for storing and accessing electronic data on any recordable, rewritable, or readable electronic, optical, or magnetic storage medium.

For two-dimensional automatic control of the attachment 340, the controller 465 may be configured to receive the geospatial positioning signal 440 from the positioning receiver 435, the boom position signal 245, the attachment position signal 375, the operator signal 470 or input, and reference the memory device 500 and change the work vehicle control 90 between the standard configuration 105 and the updated configuration 110. The controller 465 may be configured to control an elevation of the attachment 340 according to the grade command 70 by controlling the hydraulic system 275.

Alternatively, for three-dimensional automatic control of the attachment 340, the controller 465 may be configured to receive the geospatial positioning signal 440 from the positioning receiver 435, the boom position signal 245, the attachment position signal 375, the slope signal 390, the attachment identification signal 400, the operator signal 470 or input, and change the work vehicle control 90 between the standard configuration 105 and the updated configuration 110. The controller 465 may be configured to control an elevation and a slope of the attachment 340 according to the grade command 70.

Figure 7:
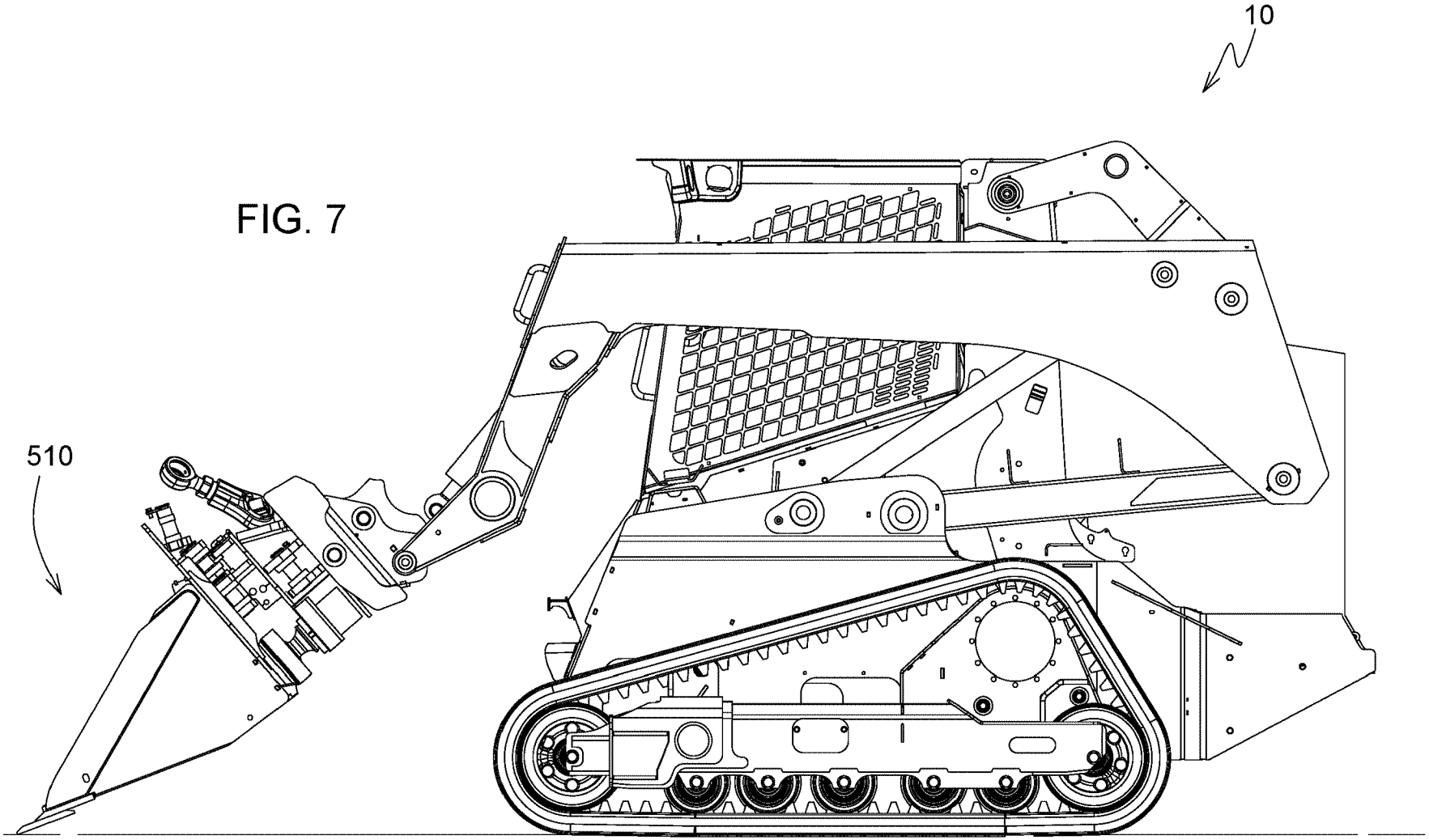
FIG. 7 is a perspective view of the work vehicle of FIG. 1, showing the boom assembly in a dump position.

The controller 465 may be configured to control the hydraulic system 275 to control the elevation and the slope of the attachment 340 according to the grade command 70. The controller 465 may be configured to control the hydraulic system 275 to maintain the cutting edge 365 on the cutting plane 450. The controller 465 may be configured to receive the boom position signal 245, the attachment position signal 375, and the grade command 70, and maintain the cutting edge 365 on the cutting plane 450 in both an operating position 505 (FIG. 3) and a dump position 510 (FIG. 7).

In operation, an operator may enter the operator's station 40 or access the work vehicle 10 remotely via the work vehicle wireless communication device 485 or the communication bus 490. The operator may turn on the work vehicle 10 with the operator input device 60 such as the SSM 85. The operator may move the work vehicle 10 towards an attachment 340 using the work vehicle control 90. When the work vehicle 10 contacts, but before it moves the attachment 340, the activation event 405 occurs and the identification device 395 sends the attachment identification signal 400. Alternatively, the activation event 405 may occur when the activation sensor 425 sends the activation signal 420 to the identification device 395 causing the identification device 395 to send the attachment identification signal 400. The operator interface 50 or display 55 may show the attachment identification signal 400 or, if more than attachment 340 is present with the identification devices 395 activated, the operator interface 50 or display 55 may show the attachment identification signals 400 in order of strength of the attachment identification signals 400 starting with the strongest signal representing the closest attachment 340 to the work vehicle 10.

The operator would position the work vehicle 10 to couple to the attachment 340. After the attachment 340 is coupled to the work vehicle 10, the operator interface 50 or display 55 may request the operator to provide the operator input indicative of the attachment confirmation 430 or the grade command 70. The operator interface 50 or display 55 may show the attachment dimensions 415 and the type of attachment 340 such as the bucket 345, dozer blade 350, the forks 355, the trencher 360, or other attachment 340 (e.g., grapple, auger) as a part of the attachment confirmation 430. The operator may enter the operator input with the display 55 or the operator input device 60.

If the attachment 340 is a dozer blade 350, the operator may lock the boom assembly 195 to the frame 15 with the boom lock 290. The operator may activate the boom lock 290 by entering the operator input with the operator interface 50 or display 55 or the operator input device 60 causing the controller 465 to receive the operator signal 470. Upon receiving the operator signal 470, the controller 465 may transmit the boom lower signal to the hydraulic system 275 to lower the boom assembly 195 to the frame 15. The controller 465 may transmit the boom lock signal 480 to the hydraulic actuator 330 or the electronic actuator 335 to move the boom lock 290 to the locked position 300. Once the dozer blade 350 is attached to the work vehicle 10 and the boom lock 290 is in the locked position 300, the operator may provide operator input to the operator interface 50 or the operator input device 60 to select dozer mode 120 thus reconfiguring the work vehicle control 90 to be more like that of a standard dozer or crawler.

When the dozer blade 350 is coupled to the attachment coupler 250 a load path 515 does not pass through the lower links 205 of the boom assembly 195. The load path 515 may pass through the dozer blade 350, the boom assembly 295, the boom lock 290, and the frame 15. The tilt cylinders 260 are configured to move or tilt the attachment 340 in both the unlocked position 295 and the locked position 300. For example, in the locked position 300, the tilt cylinders 260 may raise the attachment 340 off of the surface 30. The tilt cylinders 260 may move the attachment 340 from the operating position 505 to the dump position 510. As the attachment 340 is raised from the operating position 505 to the dump position 510, the attachment 340 may be rotated to maintain the cutting edge 365 on the cutting plane 450. For example, if the attachment 340 is the bucket 345, the bucket 345 may be configured to dump and spread contents or a material in the dump position 510. The standard configuration 105 may be for controlling the bucket 345 and the updated configuration 110 may be for controlling the dozer blade 350 or other attachments 340.

The grade control system 445 may receive the grade command 70 and define the cutting plane 450. The controller 465 may receive the grade command, the geospatial positioning signal 440, the boom position signal 245, the attachment position signal 375, and the slope signal 390, to automatically control the elevation and slope of the attachment 340 as the work vehicle 10 traverses the surface 30.

Figure 9A:
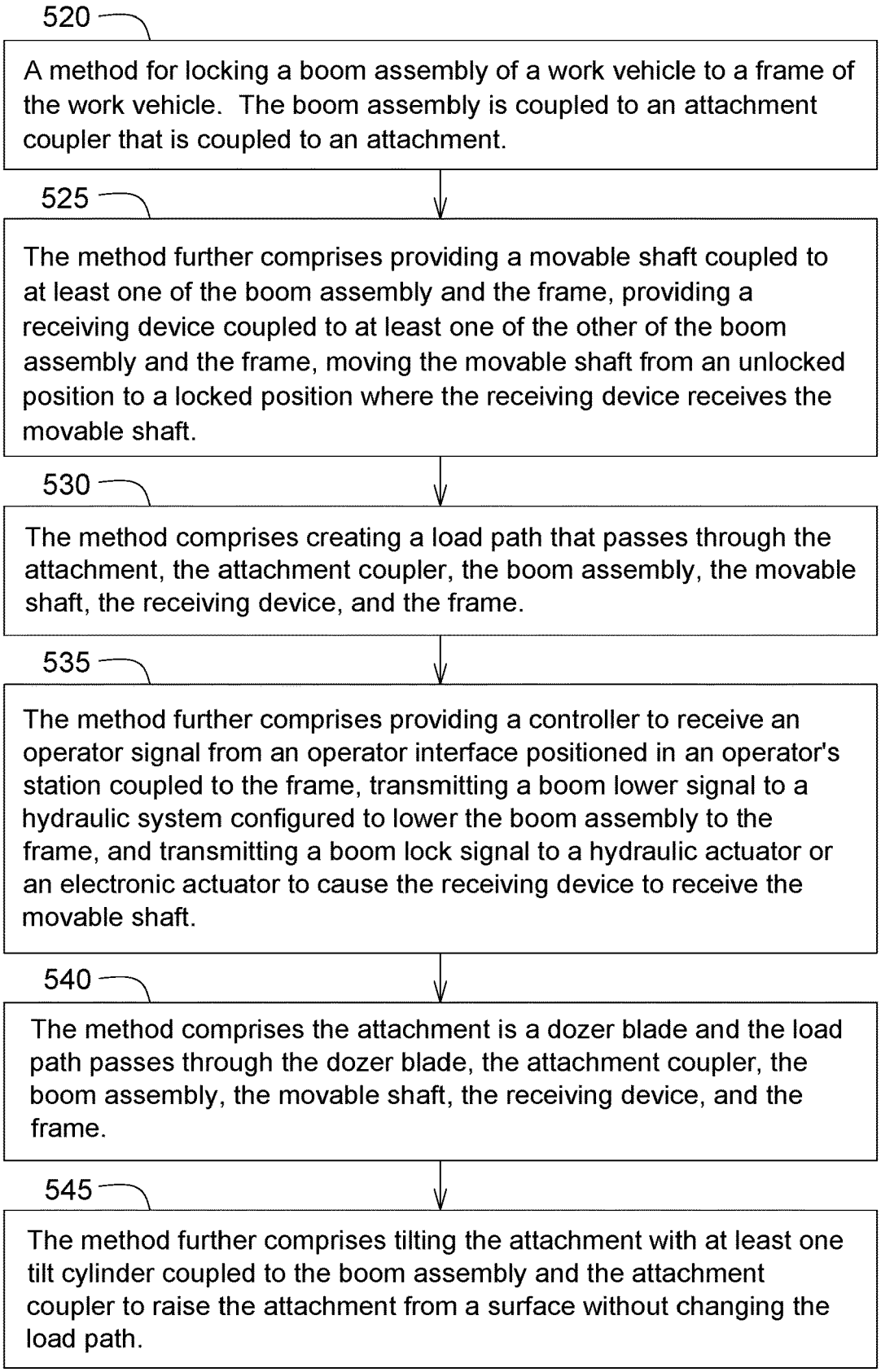
FIG. 9A is a schematic of an illustrative method for locking a boom assembly of a work vehicle to a frame of the work vehicle.

A method for locking a boom assembly 195 of a work vehicle 10 to a frame 15 of the work vehicle 10 is illustrated in FIG. 9A. In Step 520, the boom assembly 195 is coupled to an attachment coupler 250 that is coupled to an attachment 340. In Step 525, the method further comprises providing a movable shaft 310 coupled to at least one of the boom assembly 195 and the frame 15, providing a receiving device 305 coupled to at least one of the other of the boom assembly 195 and the frame 15, moving the movable shaft 310 from an unlocked position 295 to a locked position 300 where the receiving device 305 receives the movable shaft 310. In Step 530 the method comprises creating a load path 515 that passes through the attachment 340, the attachment coupler 250, the boom assembly 195, the movable shaft 310, the receiving device 305, and the frame 15.

In Step 535 the method further comprises providing a controller 465 to receive an operator signal 470 from an operator interface 50 positioned in an operator's station 40 coupled to the frame 15, transmitting a boom lower signal 475 to a hydraulic system 275 configured to lower the boom assembly 195 to the frame 15, and transmitting a boom lock signal 480 to a hydraulic actuator 330 or an electronic actuator 335 to cause the receiving device 305 to receive the movable shaft 310.

In Step 540 the method comprises the attachment 340 is a dozer blade 350 and the load path 515 passes through the dozer blade 350, the attachment coupler 250, the boom assembly 195, the movable shaft 310, the receiving device 305, and the frame 15.

In Step 545 the method further comprises tilting the attachment 340 with at least one tilt cylinder 260 coupled to the boom assembly 195 and the attachment coupler 250 to raise the attachment 340 from a surface 30 without changing the load path 515.

Figure 9B:
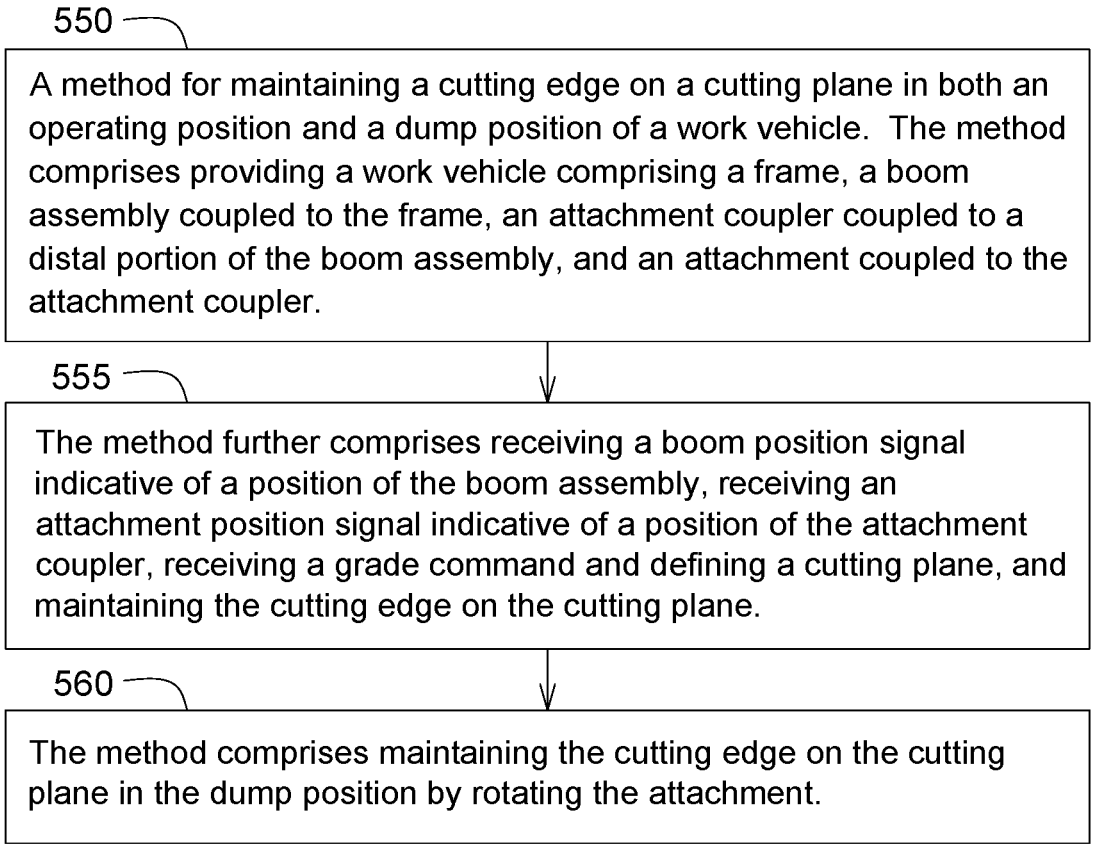
FIG. 9B is a schematic of an illustrative method for maintaining a cutting edge on a cutting plane in both an operating position and a dump position of a work vehicle.

A method for maintaining a cutting edge 365 on a cutting plane 450 in both an operating position 505 and a dump position 510 of a work vehicle 10 is illustrated in FIG. 9B. In Step 550 the method comprises providing a work vehicle 10 comprising a frame 15, a boom assembly 195 coupled to the frame 15, an attachment coupler 250 coupled to a distal portion 255 of the boom assembly 195, and an attachment 340 coupled to the attachment coupler 250. In Step 555 the method further comprises receiving a boom position signal 245 indicative of a position of the boom assembly 195, receiving an attachment position signal 375 indicative of a position of the attachment coupler 250, receiving a grade command 70 and defining a cutting plane 450, and maintaining the cutting edge 365 on the cutting plane 450. In Step 560 the method comprises maintaining the cutting edge 365 on the cutting plane 450 in the dump position 510 by rotating the attachment 340.

What is claimed is:

1. A work vehicle comprising:

a frame;

at least one ground engaging device coupled to the frame and configured to support the frame above a surface;

a positioning receiver coupled to the frame and configured to receive a geospatial positioning signal;

a boom assembly coupled to the frame;

at least one boom cylinder coupled to the frame and the boom assembly and configured to move the boom assembly;

a boom position sensor coupled to at least one of the frame, the boom assembly, and the boom cylinder and configured to transmit a boom position signal indicative of a position of the boom assembly;

an attachment coupler coupled to a distal portion of the boom assembly;

at least one tilt cylinder coupled to the boom assembly and the attachment coupler and configured to move the attachment coupler;

an attachment position sensor coupled to at least one of the boom assembly, the attachment coupler, and the tilt cylinder and configured to transmit an attachment position signal indicative of a position of the attachment coupler;

an attachment coupled to the attachment coupler;

at least one of an IMU and a slope sensor coupled to the attachment and configured to transmit a slope signal indicative of a slope of the attachment relative to the frame, the controller configured to control the elevation and a slope of the attachment according to the grade command an identification device coupled to the attachment and configured to transmit an attachment identification signal after an activation event;

a display communicatively coupled to the identification device and configured to display the attachment identification signal, the display comprising an operator input device configured to receive an operator input indicative of an attachment confirmation and a grade command;

a work vehicle control that is re-assignable from a standard configuration to an updated configuration by way of operator input to the operator input device; and a controller configured to receive the geospatial positioning signal, the boom position signal, the attachment position signal, the slope signal, the attachment identification signal, and the operator input, the controller configured to control an elevation and a slope of the attachment according to the grade command.

2. The work vehicle of claim 1, wherein the attachment is at least one of a bucket and a dozer blade.

3. The work vehicle of claim 2, wherein the standard configuration is for controlling a bucket and the updated configuration is for controlling a dozer blade.

4. The work vehicle of claim 1, further comprising a hydraulic system fluidly coupled to the boom cylinder and the tilt cylinder, the controller configured to control the hydraulic system to control the elevation of the attachment according to the grade command.

5. The work vehicle of claim 1, wherein the attachment device is a beacon assembly.

6. The work vehicle of claim 1, wherein the attachment identification signal comprises at least one of an attachment dimension and a work vehicle setting.

7. The work vehicle of claim 1, wherein the activation event comprises the work vehicle contacting the attachment with a minimum force where the attachment remains stationary.

8. The work vehicle of claim 1, further comprising a boom lock coupled to at least one of the frame and the boom assembly, the boom lock configured to move from an unlocked position where the boom assembly is moveable to a locked position where the boom assembly is locked to the frame in a lowered position when the attachment identification signal indicates that the attachment is a dozer blade.

9. A work vehicle comprising:

a frame;

at least one ground engaging device coupled to the frame and configured to support the frame above a surface;

a positioning receiver coupled to the frame and configured to receive a geospatial positioning signal;

a boom assembly coupled to the frame;

at least one boom cylinder coupled to the frame and the boom assembly and configured to move the boom assembly;

a boom position sensor coupled to at least one of the frame, the boom assembly, and the boom cylinder and configured to transmit a boom position signal indicative of a position of the boom assembly;

an attachment coupler coupled to a distal portion of the boom assembly;

at least one tilt cylinder coupled to the boom assembly and the attachment coupler and configured to move the attachment coupler;

an attachment position sensor coupled to at least one of the boom assembly, the attachment coupler, and the tilt cylinder and configured to transmit an attachment position signal indicative of a position of the attachment coupler;

a dozer blade coupled to the attachment coupler;

at least one of an IMU and a slope sensor coupled to the dozer blade and configured to transmit a slope signal indicative of a slope of the dozer blade relative to the frame, the controller configured to control the elevation and a slope of the dozer blade according to the grade command;

an identification device coupled to the dozer blade and configured to transmit an attachment identification signal after an activation event;

a boom lock coupled to at least one of the frame and the boom assembly, the boom lock configured to move from an unlocked position where the boom assembly is moveable to a locked position where the boom assembly is locked to the frame in a lowered position when the attachment identification signal indicates the dozer blade;

a display communicatively coupled to the identification device and configured to display the attachment identification signal, the display comprising an operator input device configured to receive an operator input indicative of an attachment confirmation and a grade command;

a work vehicle control that is re-assignable from a standard configuration to an updated configuration by way of operator input to the operator input device; and a controller configured to receive the geospatial positioning signal, the boom position signal, the attachment position signal, the slope signal, the attachment identification signal, and the operator input, the controller configured to control an elevation and a slope of the dozer blade according to the grade command.

* * * * *